United States Patent [19]

Kunsagi et al.

[11] 4,226,282

[45] Oct. 7, 1980

[54] HEAT EXCHANGE APPARATUS UTILIZING THERMAL SIPHON PIPES

[75] Inventors: Laszlo Kunsagi, Montclair; Ernest L. Daman, Westfield, both of N.J.

[73] Assignee: Foster Wheeler Energy Corporation, Livingston, N.J.

[21] Appl. No.: 938,242

[22] Filed: Aug. 30, 1978

Related U.S. Application Data

[62] Division of Ser. No. 707,575, Jul. 22, 1976.

[51] Int. Cl.[3] ..... F28B 1/06

[52] U.S. Cl. ..... 165/105; 165/110; 165/DIG. 1; 165/DIG. 5

[58] Field of Search ..... 165/105, 110, DIG. 5, 165/DIG. 1

[56] References Cited

U.S. PATENT DOCUMENTS

| | | | |
|---|---|---|---|
| 837,499 | 12/1906 | Perkins et al. | 165/105 |
| 2,028,260 | 1/1936 | Vernet | 165/105 X |
| 2,374,184 | 4/1945 | Kleen | 165/DIG. 5 X |
| 3,347,309 | 10/1967 | Webb | 165/105 X |

FOREIGN PATENT DOCUMENTS

| | | | |
|---|---|---|---|
| 214877 | 5/1924 | United Kingdom | 165/105 |

*Primary Examiner*—Albert W. Davis

*Attorney, Agent, or Firm*—Marvin A. Naigur; John E. Wilson; John J. Herguth, Jr.

[57] ABSTRACT

A heat exchange apparatus in which each of a plurality of thermal siphon pipes has an upper portion extending in an upper heat exchange section and a lower portion extending in a lower heat exchange section. Each pipe is closed at its ends and contains a heat transfer fluid so that when a hot fluid is passed through the lower heat exchange section, the heat is transferred from the hot fluid to the heat exchange fluid. A cool fluid is passed through the upper heat exchange section to remove the heat from the heat exchange fluid.

9 Claims, 6 Drawing Figures

HEAT EXCHANGE APPARATUS UTILIZING THERMAL SIPHON PIPES

This application is a divisional of application Ser. No. 707,575, filed July 22, 1976.

BACKGROUND OF THE INVENTION

This invention relates to a heat exchanger and, more particularly, to a heat exchanger utilizing a plurality of thermal siphon pipes which contain a heat exchange fluid for removing heat from a hot fluid, such as steam.

In electrical power generation systems, the spent steam from a steam turbine is normally passed to a once-through condenser in which feedwater is passed in a heat exchange relationship with the steam to condense the steam. However, in view of the substantial water consumption and thermal pollution involved, these types of condensers are becoming less and less desirable.

As a result, various types of dry heat exchangers have been suggested which, in their basic form, utilize pressurized air to condense the steam. However, these dry condensers are considerably more expensive than the water condensers discussed above because of the fan power required and the high cost of the heat exchanger portion of the condenser. Also, the dry condensers have poorer cooling potential than the water condensers.

A third form of heat exchanger that is possible in these types of environments is the so-called heat pipe heat exchanger which utilize a plurality of horizontally extending pipes, closed at each end and having a wicking material formed on their interior surface. A heat exchange fluid is disposed in the pipes and is vaporized by the heat of the steam which is passed over a portion of the pipes, and air or the like is passed over the other portions of the pipes to condense the heat exchange fluid. However, these types of arrangements are unpractical in a large system since the wicking material is expensive, the pipes are difficult and costly to manufacture, and the pipes are restricted to use in a horizontal position.

SUMMARY OF THE INVENTION

It is therefore an object of the present invention to provide a heat exchange apparatus which is air cooled and which can be manufactured at a relatively low cost.

It is a further object of the present invention to provide a heat exchange apparatus of the above type which minimizes the need of excessive fan power and the use of heat pipes requiring internal wicking material.

It is a further object of the present invention to provide a heat exchange apparatus of the above type which employs a plurality of gravity controlled, thermal siphon pipes constructed and arranged in a unique manner.

Toward the fulfillment of these and other objects, the heat exchange apparatus of the present invention comprises an upper heat exchange section, a lower heat exchange section, a plurality of thermal siphon pipes each having an upper portion extending in the lower heat exchange section, each of the pipes being closed at each end and containing a heat exchange fluid, means for passing a hot fluid across the lower portions of the pipes to transfer heat from the hot fluid to the heat exchange fluid, and means for passing a cool fluid across the upper portions of the pipes to remove heat from the heat exchange fluid.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENT

Figure 1:
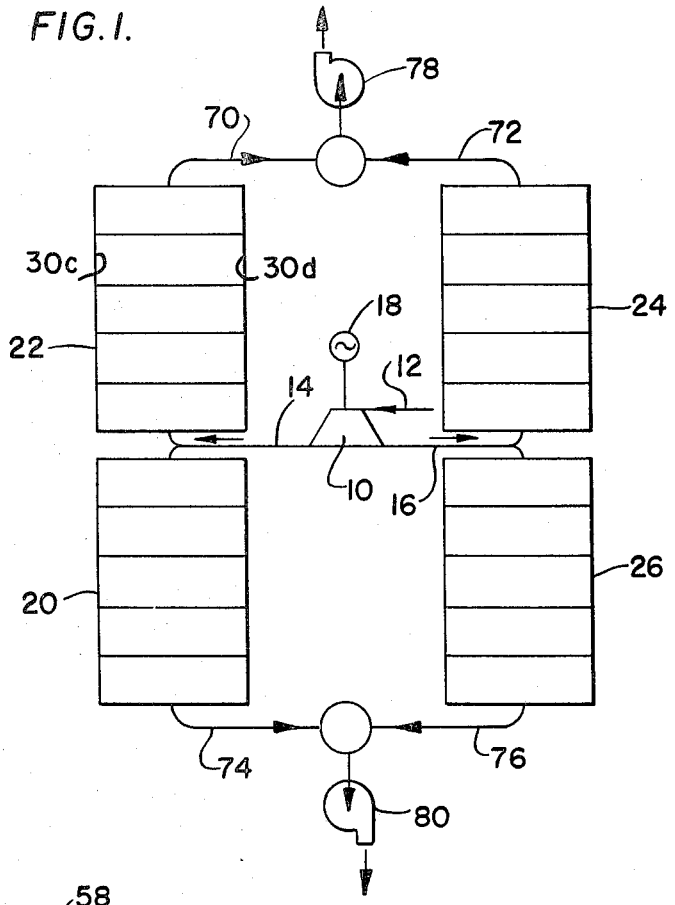
FIG. 1 is a schematic elevational view depicting a portion of a power generation system utilizing the heat exchange apparatus of the present invention.

The heat exchange apparatus of the present invention will be described, for the purposes of example, in connection with an electrical power generator plant, in which the heat exchange apparatus is utilized to condense spent steam from a turbine. Referring specifically to FIG. 1, the reference numeral 10 refers in general to a steam turbine having an inlet line 12 for introducing steam from an external source into the turbine, and two outlet lines 14 and 16 for discharging the spent steam after it has passed through the turbine. The turbine operates in a conventional manner to drive an electrical generator 18 for generating electrical power, also in a conventional manner.

Four condenser sections 20, 22, 24, and 26 surround the turbine 10, with the sections 20 and 22 extending to one side of the turbine and the sections 24 and 26 extending to the other side thereof. The sections 20 and 22 receive spent steam from the line 14 and the sections 24 and 26 receive spent steam from the line 16.

Figure 3:
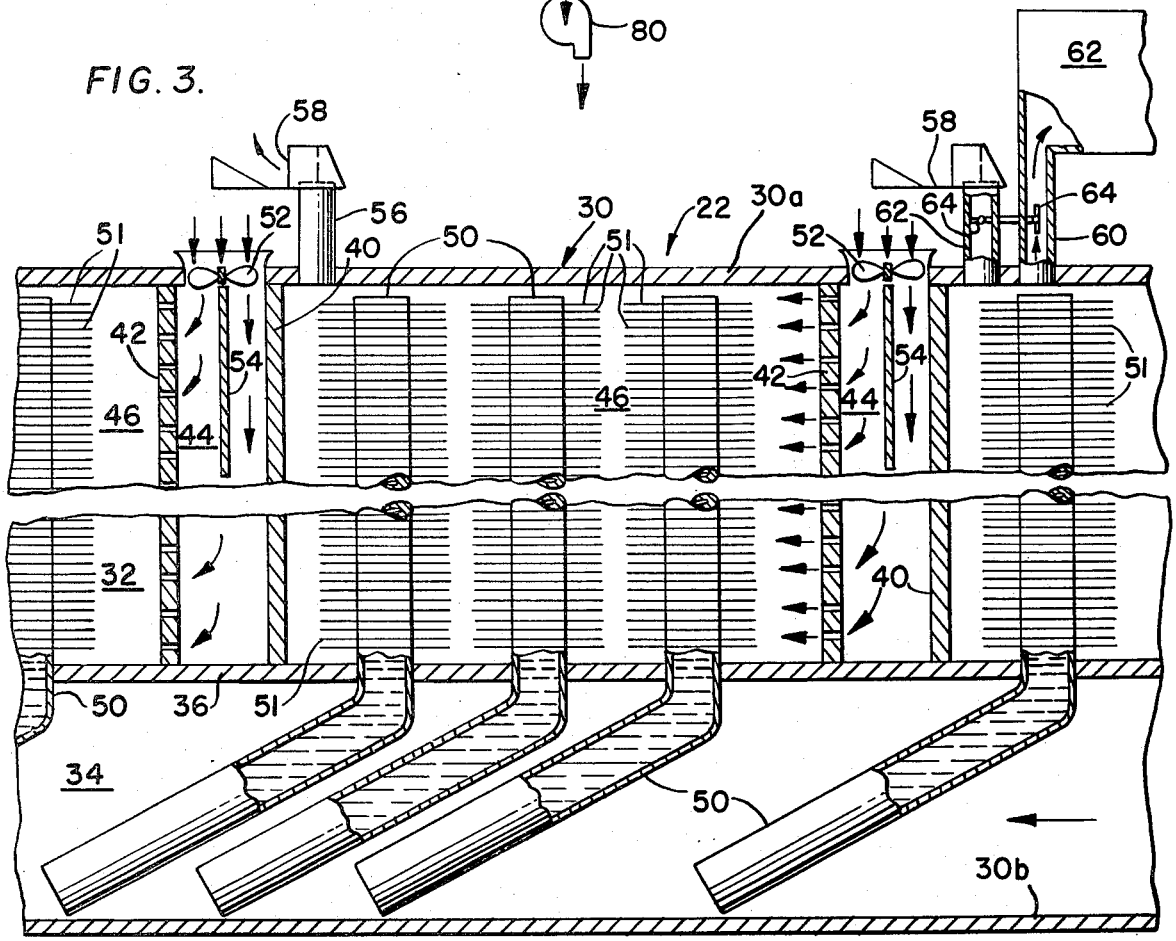
FIG. 3 is an enlarged partial view of a portion of the condenser section of FIG. 2.
Figure 2:
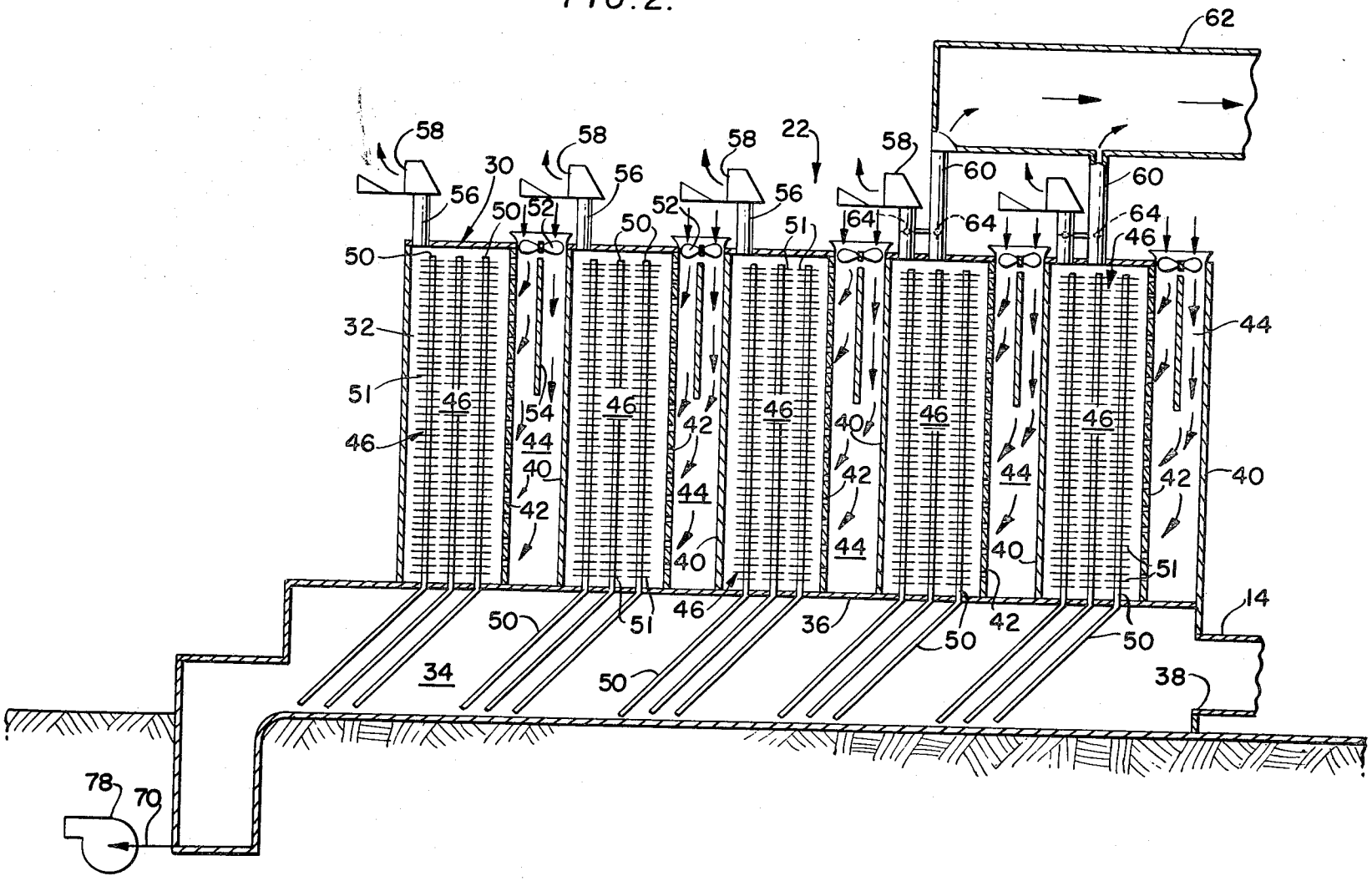
FIG. 2 is an enlarged vertical, cross-sectional view depicting one embodiment of the heat exchange apparatus of the present invention.

One embodiment of a condenser section 22 is depicted in detail in FIGS. 2 and 3, it being understood that the remaining sections 20, 24, and 26 can be constructed in an identical manner. In particular, the section 22 includes a housing 30 having top and bottom walls 30*a* and 30*b* and sidewalls 30*c* and 30*d* (FIG. 1) and a horizontally extending partition 36 which divides the housing into an upper portion 32 and a lower portion 34. An inlet opening 38 is provided at one end portion of the lower housing portion 34 for receiving steam from the steam line 14, for treatment in a manner to be described later.

A plurality of vertical panels or partitions 40 are provided in a spaced relationship in the upper housing portion 32, with the end partitions 40 forming the end walls of the housing. A plurality of perforated vertical panels or partitions 42 are also provided in the upper housing portion 32 and extend between adjacent partitions 40. Each partition 42 divides the area between adjacent partitions 40 into an air plenum or passage 44 and a heat exchange compartment 46.

A plurality of thermal siphon pipes 50 are provided in the housing 30 with the upper portion of each pipe extending into and substantially enclosed by a compartment 46, and with the lower portion of each pipe extending in the lower housing portion 34. The pipes 50 are disposed in three parallel rows in each compartment 46, with the end pipes of each row being depicted. It is understood that the number of pipes 50 in each row can vary according to particular design requirements. A plurality of heat exchange fins 51 extend over the upper portions of the pipes 50 in the compartments 46, and the lower portion of each of the pipes 50 extends at an angle relative to the upper portion thereof, for reasons that will be described in detail later. Each pipe 50 is closed at its ends and contains a heat exchange fluid, such as ammonia, which is vaporized in the portion of the pipe extending in the lower housing portion 34 and is condensed in the portion of the pipe extending in the compartment 46, as will be described in detail later.

A fan 52 is disposed in the upper portion of each air passage 44 and operates to draw ambient air into the passage 44 in a generally downwardly direction as viewed in FIGS. 2 and 3. A baffle 54 is provided in each air passage 44 to direct a portion of the air into the lower portion of the passage. The air then passes through the perforations in the partitions 42 in a general right-to-left direction and across the upper portions of the pipes 50 in the heat exchange compartments 46. A plurality of vent pipes 56 extend through the upper wall of the housing 30 for receiving the air after it has passed through the compartments 46 after which the air is discharged through a wind vane 58 mounted at the upper end of each of the vent pipes 56.

As shown in FIG. 2, an additional air vent pipe 60 is associated with two of the compartments 46 and operates to pass a portion of the air exiting from the latter compartments into a collection duct 62. The collection duct 62 is utilized to recirculate the relatively warm air to the boiler (not shown) associated with the steam turbine 10 to supply the combustion air of the boiler. As better shown in FIG. 3, the passage of air through the vent pipes 56 and 60 associated with the latter two compartments 46 can be selectively controlled by means of manually operated damper valves 64 disposed in each pipe in accordance with the particular combustion air requirements of the boiler. It is understood that the number of compartments 46 having an additional air vent pipe 60 can be varied as needed.

Referring again to FIG. 1, a pair of condensed steam lines 70 and 72 connect the outlet end of the lower housing portions 34 of the condenser sections 22 and 24, respectively, to a pump 78; and lines 74 and 76 connect the lower housing portions of the condenser sections 20 and 26, respectively, to a pump 80. The pumps 78 and 80 operate to draw the condensed steam from the condenser sections 20, 22, 24, and 26 and pump it to a collection tank (not shown), or the like, for further treatment.

In operation, the steam is discharged from the turbine 10 through the lines 14 and 16 to the condenser sections 20, 22, 24, and 26 where it passes into and through the lower housing portion 34 of each section and across the lower portions of the pipes 50. The heat from the steam is transferred to the heat exchange fluid in the pipes 50 whereupon the steam condenses and the heat exchange fluid vaporizes and rises to the upper portions of the pipes 50 located in the compartments 46. The fans 52 force relatively cool ambient air into the air passages 44, through the perforated partitions 42, and across the upper portions of the pipes 50 to transfer the heat from the heat exchange fluid in the pipes to the air before the air exits through the vent pipes 56 and, in the case of a portion of the compartments 46, through the vent pipes 60. During the passage of air across the upper portion of the pipes 50, the heat exchange fluid in the pipes condenses and drips under the force of gravity to the lower portions of the pipes in the lower housing portion 34 to continue the transfer of heat in the above manner.

Referring again to FIG. 1, the condensed steam is drawn from condenser sections 20, 22, 24, and 26, via lines 70, 72, 74, and 76, under the force of pumps 78 and 80 from which it is passed to collection tanks, or the like, for further treatment.

Figure 4:
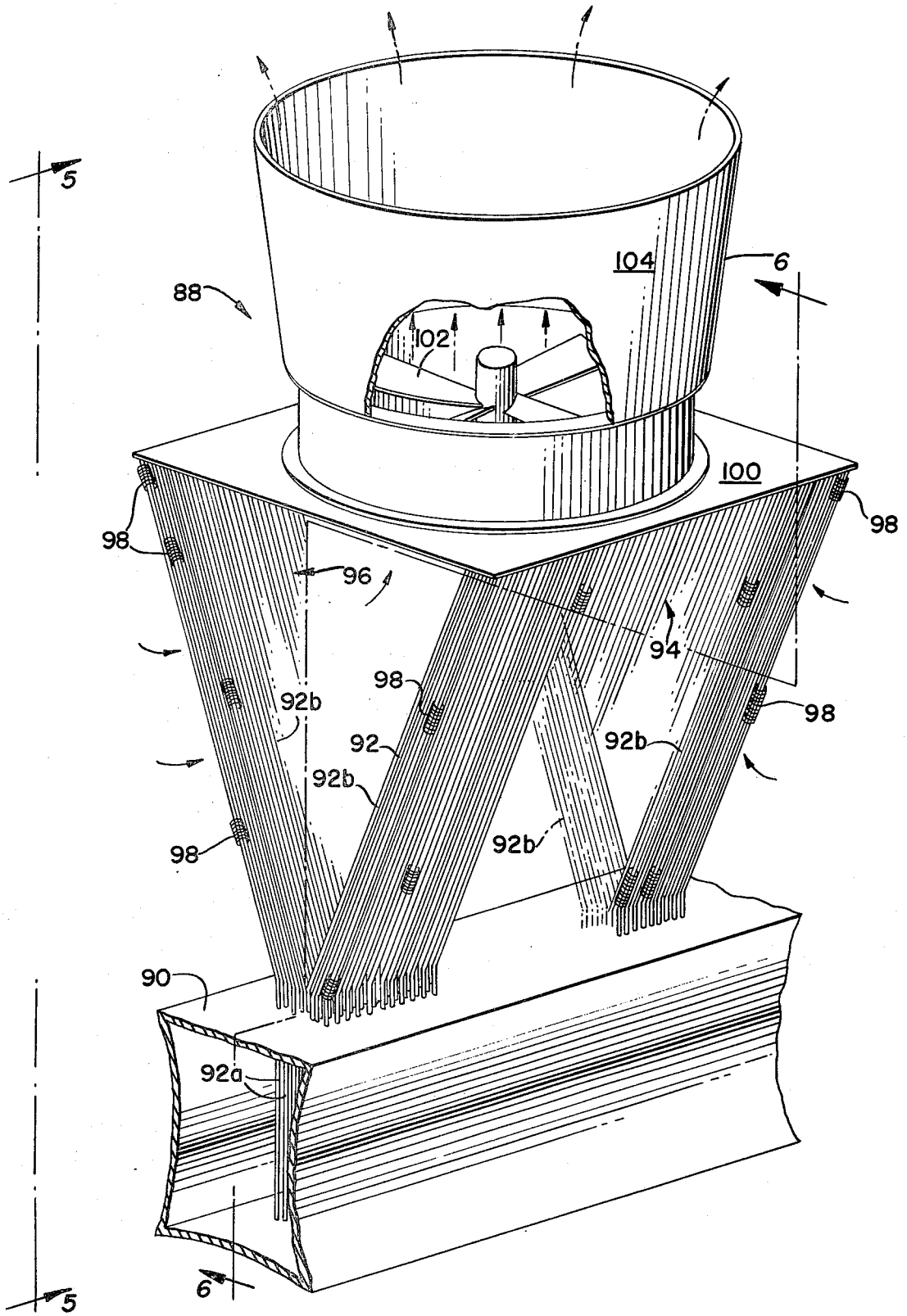
FIG. 4 is an enlarged perspective view of another embodiment of the heat exchange apparatus of the present invention.
Figure 5:
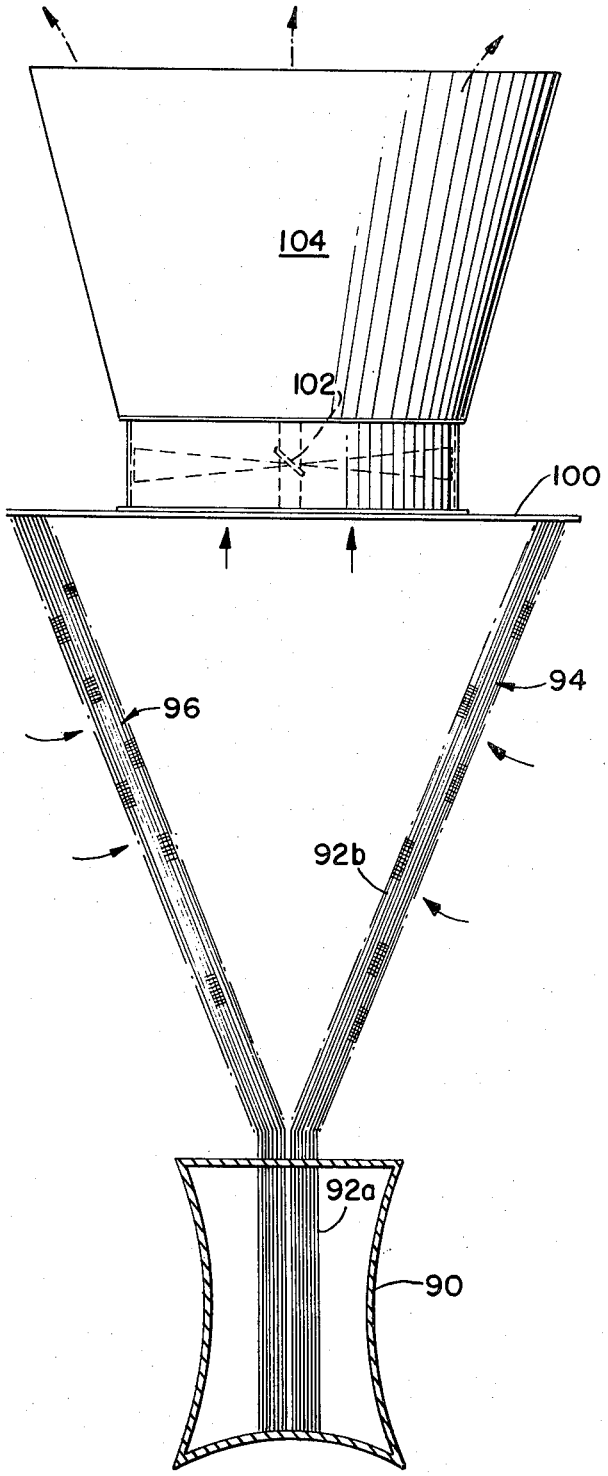
FIGS. 5 and 6 are cross-sectional views taken along the lines 5—5 and 6—6, respectively, of FIG. 4.
Figure 6:
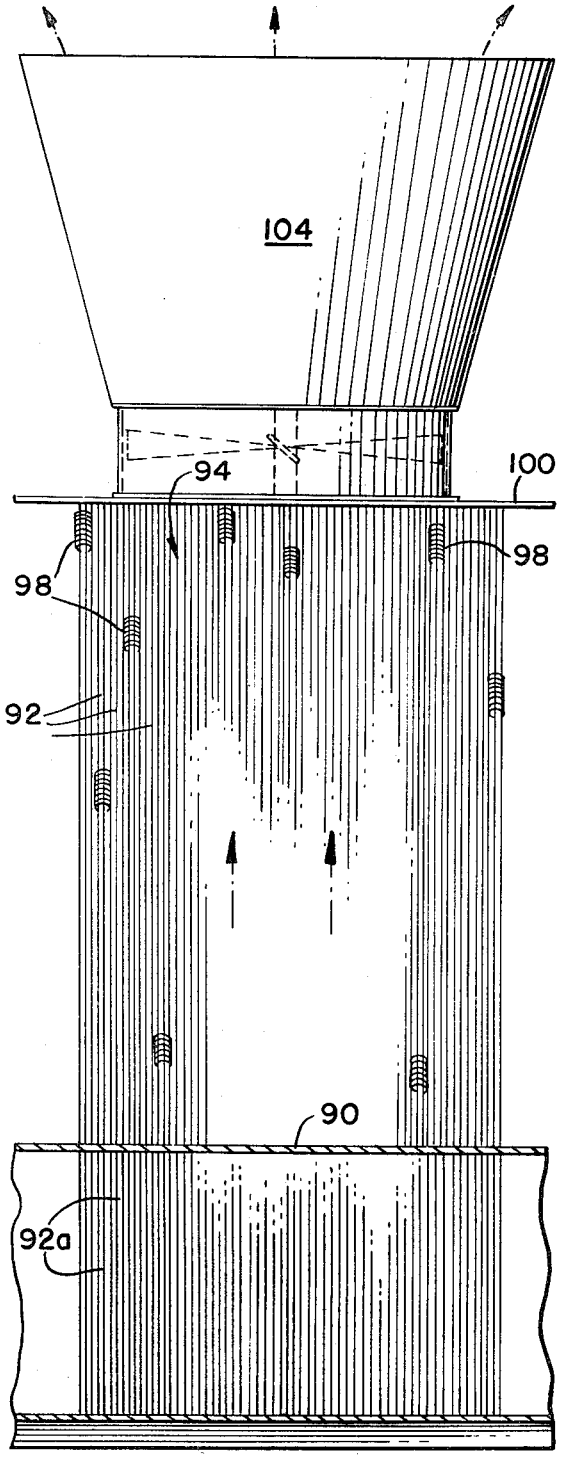

Another embodiment of the condenser section is referred to in general by the reference numeral 88 in FIGS. 4–6, and includes a duct 90 which is provided for receiving the steam from the pipes 14 or 16 and discharging the condensed steam to the lines 70 and 72 in a manner similar to that of the lower housing portion 34 of the previous embodiment. A plurality of heat pipes 92 are provided with each having a lower portion 92*a* extending within the duct 90 and an upper portion 92*b* projecting outwardly from the upper surface of the duct. The upper heat pipe portions 92*b* extend at an angle with respect to the lower portions 92*a* and laterally with respect to the duct 90. The heat pipes 92 are divided into two groups 94 and 96, with the heat pipes in one group extending toward one side of the duct 90 and the heat pipes in the other group extending toward the other side of the duct. Each group 94 and 96 contains four rows of heat pipes 92 with each row extending along the length of the duct 90. In this manner the heat pipes 92 form a substantial Y-shaped configuration when viewed from the end of the duct 90, with the stem of the Y extending into the duct 90.

A plurality of fins 98 are provided over the upper heat pipe portion 92*b* with only a few of the fins being depicted, for the convenience of presentation. Each heat pipe 92 is closed at each end, contains a heat exchange fluid, and operates in identical fashion to the heat pipes 50 in the previous embodiment.

A support plate 100 extends over and is connected to the upper ends of the heat pipes 92 and supports an induced draft fan 102 and a hood 104 which extends around the fan and which is open at its upper end. An opening (not shown) is provided in the support plate 100 to permit air to be drawn by the fan 102 across the upper heat pipe portions 92*b* and through the hood 104 for discharge into atmosphere as shown by the flow arrows.

In operation, the fan 102 operates to pull air across the upper heat pipe portions 92*b* of both groups 94 and 96 of heat pipes, and through the hood 104, which cools the heat exchange fluid in the upper heat pipe portions 92*b*. The heat exchange fluid condenses and drips downwardly into the lower heat pipe portions 92*b* in the duct 90 and is vaporized by virtue of its heat exchange with the steam passing through the latter duct.

it is understood that the lower heat pipe portions 92*a* may be slanted in the same manner as the lower portions of the heat pipes 50 in the previous embodiment.

Several advantages result from the arrangement of the present invention. For example, the necessity for a wick or the like in connection with the heat pipes of both embodiments is eliminated since the pipes operate as gravity controlled, thermal siphons, i.e. the condensed heat exchange fluid in the pipes drips under the force of gravity from the upper portion of the pipes to the lower portions thereof.

Also, in the embodiment of FIGS. 2 and 3 the slanted lower portions of the heat pipes enable their length to be increased without increasing the structural size of the steam passage, and in addition reduce the resistance to the steam flow. Further, the technique in the embodiment of FIGS. 2 and 3 of utilizing at least a portion of the heated air exiting from the boiler results in an increased efficiency of the overall system.

In the embodiment of FIGS. 4–6, the Y shape of the heat pipes minimizes air direction and velocity changes and reduces recirculation of hot air through the system when compared to forced draft fan air cool modules. Also, in the embodiment of FIGS. 4–6 the packing density of the heat pipes is relatively high, resulting in a relatively high air cooled surface area per unit length duct which of course minimizes the space requirements for the heat exchange apparatus. Also, the embodiment of FIGS. 4–6 enables the most economical fan size to be selected by varying the number of heat pipes and the angle that the upper heat pipe portions make with the lower heat pipe portions.

It can be appreciated that the present invention is not restricted to use in a steam condensing environment, but can be used in any situation in which a heat exchange between two fluids is desired.

It is understood that other variations of the specific construction and arrangement of the apparatus disclosed above can be made by those skilled in the art without departing from the invention as defined in the appended claims.

What is claimed is:

1. A heat exchange apparatus comprising a plurality of heat exchange sections, partition means for dividing each section into an upper portion and a lower portion, additional partition means for dividing the upper portion of each of said sections into a plurality of horizontally aligned compartments, a plurality of thermal siphon pipes each having an upper portion extending into said compartments and a lower portion extending into said lower portion of said section, each of said pipes being closed at each end and containing a heat exchange fluid, means for connecting the lower portion of said sections to a source of relatively hot fluid so that said hot fluid passes across said lower portions of said pipes to transfer heat from said hot portion to said heat exchange fluid, fan means associated with each compartment for passing relatively cool ambient air across said upper portions of said pipes to remove heat from said heat exchange fluid, an outlet for exhausing said air to the atmosphere after it has passed over said upper portions of said pipes, and an additional outlet for passing said air to a collection duct for further treatment after the air has passed over said upper portions of said pipes.

2. The apparatus claimed in claim 1 further comprising:

means associated with each compartment for selectively directing said air through said outlets.

3. The apparatus claimed in claim 2 wherein said directing means comprises:

damper means located in each of said outlets and operable to selectively direct the air through said outlets.

4. A heat exchanger for exchanging heat energy from a relatively hot fluid to a relatively cooler fluid comprising:

a heat exchanger housing defined by top, bottom and side walls, a partition dividing the interior of said housing into an upper portion and a lower portion, a plurality of thermal siphon pipes extending through said partition with their respective evaporator sections located in said lower portion and their respective condenser sections located in said upper portion, a plurality of panels internal to said upper portion dividing the upper portion into a plurality of heat transfer compartments and adjacent cooling fluid plenums, said compartments substantially enclosing the upper portions of some of said thermal siphon pipes, the panel dividing each compartment from its respective plenum provided with means to substantially uniformly distribute the flow of a cooling fluid from said plenum into said compartment, each compartment provided with an outlet to exhaust the cooling fluid after it has passed over the condenser section of said thermal siphon pipes, means for introducing a flow of cooling fluid into each of said plenums and through said inlet opening to cool said condenser sections of said heat pipes.

5. The heat exchange apparatus claimed in claim 4 wherein said panel separating each cooling fluid plenum from its respective heat transfer compartment is provided with a plurality of inlet openings distributed in the surface area of said panel.

6. The heat exchange apparatus claimed in claim 5 further comprising:

a fan means for introducing a flow of cooling ambient air into said plenum; and a baffle disposed in said plenum to distribute the ambient air to said plurality of inlet openings.

7. The heat exchange apparatus claimed in claim 6 wherein the evaporator sections of said thermal siphon pipes are inclined at an angle relative to said condenser sections.

8. The apparatus claimed in claim 6 further comprising an additional outlet opening in each compartment for passing said air to a collection duct for further treatment after the air has passed over said portions of said pipes.

9. The apparatus claimed in claim 8 further comprising:

means associated with each compartment for selectively directing said air through said outlets.

* * * * *